US006799448B2

(12) United States Patent
Meier

(10) Patent No.: US 6,799,448 B2
(45) Date of Patent: Oct. 5, 2004

(54) DEVICE FOR PLACING A MECHANICAL RETAINING MEANS

(75) Inventor: Ulrich Meier, Wädenswil (CH)

(73) Assignee: Hans Oetiker AG, Horgen (CH)

( * ) Notice: Subject to any disclaimer, the term of this patent is extended or adjusted under 35 U.S.C. 154(b) by 0 days.

(21) Appl. No.: 10/167,110

(22) Filed: Jun. 11, 2002

(65) Prior Publication Data

US 2002/0148265 A1 Oct. 17, 2002

Related U.S. Application Data

(63) Continuation of application No. 09/623,078, filed as application No. PCT/CH98/00522 on Dec. 9, 1998, now Pat. No. 6,430,979.

(30) Foreign Application Priority Data

Feb. 26, 1998 (CH) ..... 460/98

(51) Int. Cl.[7] ..... B21D 39/04; B21D 41/04

(52) U.S. Cl. ..... 72/21.4; 72/407; 29/702

(58) Field of Search ..... 72/21.4, 402, 404, 72/407; 29/705, 701, 702

(56) References Cited

U.S. PATENT DOCUMENTS

| | | | | |
|---|---|---|---|---|
| 5,058,272 | A | 10/1991 | Steube | 83/701 |
| 5,195,042 | A | 3/1993 | Ferraro | 29/753 |
| 5,195,353 | A | 3/1993 | Erbrick | 72/35 |
| 5,271,254 | A | 12/1993 | Gloe | 29/705 |
| 5,337,589 | A | 8/1994 | Gloe | 29/753 |
| 5,937,505 | A | 8/1999 | Strong | 29/705 |
| 6,035,775 | A | 3/2000 | Ngheim | 100/43 |

*Primary Examiner*—Daniel C. Crane
(74) *Attorney, Agent, or Firm*—Pearne & Gordon LLP

(57) ABSTRACT

An apparatus for mounting mechanical fasteners comprises first elements to set, limit and/or measure a path or a length or a distance when the fastener is being mounted. Said apparatus also comprises second elements to set, limit and/or measure at least one force component at the fastener, said force component being built up when covering or overcoming the path of the fastener, or by this fastener.

16 Claims, 7 Drawing Sheets

DEVICE FOR PLACING A MECHANICAL RETAINING MEANS

Figure 1:
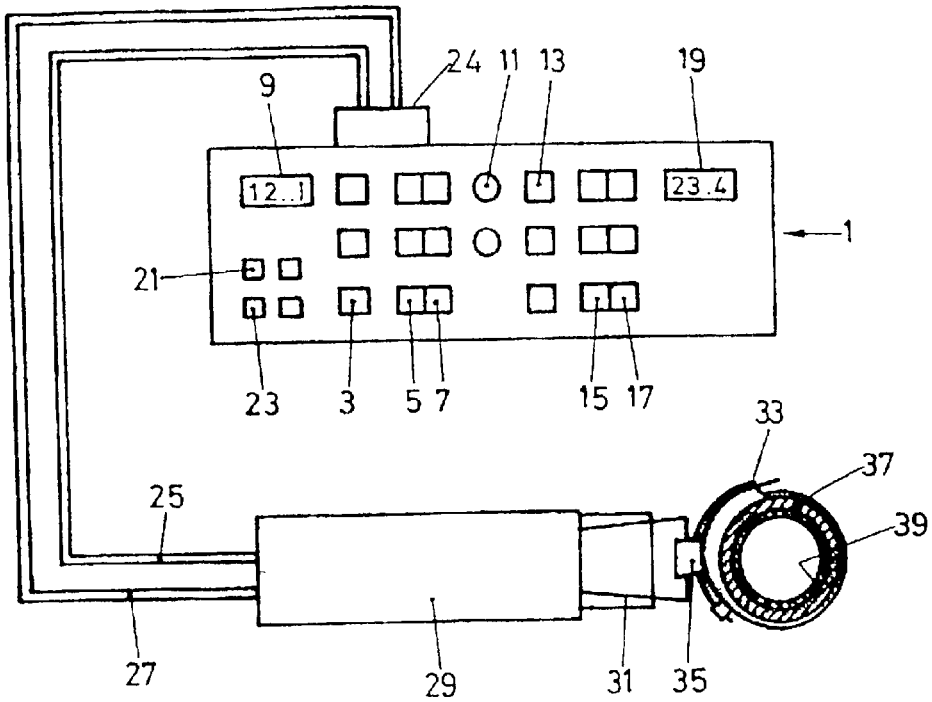

The present invention relates to a device, hereafter apparatus, for mounting a retaining element, hereafter fastener, to a system to affix or clamping a clamp, a collar or a compression ring, to the application of said device or system to mount, clamp or compress clamps, collars, clamping rings or compression rings, and also to a method for mounting a mechanical fastener in controlled and monitored manner.

As regards manufacturers' warranties for instance according to ISO 9000, ISO 9001, ISO 9002 etc., and other standards, increasing significance is being attached to quality control, quality assurance, and to monitoring production and assembly procedures.

In particular it matters in machine construction and automotive engineering that, during assembly, any component shall meet certain quality standards both with respect to material quality and to mounting the parts. Additionally however to materials data, it is also important that the assembly procedure can be checked and understood any time, even subsequently, especially when damages or accidents arise, so that any damaging parts or defective assemblies may be ascertained in order to determine whether such were the cause of the damage or accident.

Materials data already have been long recorded, for instance production data, so-called batch data or charge data, or production units, also by reference to quality logs, protocols and the like.

On the other hand assembly data often is lacking, especially regarding several components which are held together, mounted or are mutually joined by mechanical fastener such as clamps, collars, clamping rings.

Accordingly it is one objective of the present invention to create both an apparatus and a method to control, or to monitor and as appropriate to record assembly and quality control especially relating to production and assembling operations implemented by mechanical fasteners.

The goal of the invention is resolved by its apparatus defined in claim 1, by its system defined in claim 10, and by a method defined in claim 16.

It is proposed that the apparatus of the invention to mount a mechanical fastener on one hand comprises first elements to set, limit and/or measure a path or a length or a distance covered or overcome when mounting the fastener and/or ascertainable at the fastener, also second elements to set, limit and/or measure at least one force component at the fastener, where said force component builds up, when the path is covered or is overcome, at the fastener or by the fastener.

A further embodiment variation comprises at least one drive and also at least one assembling device connected to said drive to mount the fastener, the first elements to set, limit and/or measure being connected to the drive and/or the assembling device in such a way that a path or a distance shall be covered or overcome at the fastener during assembling, and/or the drive shall be interrupted, when the fastener measures or has detected a specified length of distance.

The invention also provides that the second elements to set, limit and/or measure a force component shall be connected in such manner with the assembling device and/or the fastener that at least one fastening force or restoration force shall be measured at the fastener during the mounting phase.

Moreover the second elements setting, limiting and/or measuring at least one force component shall be so linked to the assembling device and/or the fastener that at least one fastening force or restoring force shall be measured at the fastener during the mounting phase.

Again the invention proposes a setpoint element to control and monitor the first elements for the controlled implementation of the assembling procedure, also another setpoint element in order to limit to a maximum value the force component building up during assembling. Also setpoint-value/actual-value comparators are used in order, on one hand to compare the setpoint value transmitted to said first elements with the corresponding values measured at the fastener for the purpose of comparing the effective force component covered or overcome, length or distance measured at the assembling device upon termination of assembly, with the corresponding setpoint value.

On one hand the assembling is controlled and monitored by means of setpoints (or setpoint values) received in a control, measurement and test unit, and on the other hand the actual values ascertained, i.e. measured during or after assembling at the assembling device are compared with the corresponding setpoint values and, in case of a differential between the actual and the setpoint values, allowance made for given tolerances, such differentials are made noticeable by optical or acoustical signals using appropriate implements.

Further preferred embodiment variations of the device of the invention are stated in the dependent claims.

The invention furthermore proposes a system comprising the apparatus of the invention to affix or compress a clamp, collar or a compressing ring. The system of the invention is especially well suited to mount, clamp, or compress clamps, collars, clamping or compression rings for the purpose of making hose and pipe connections, for instance when hooking up hoses and pipes illustratively to a hook-up nipple, when mounting protective bellows and the like and also to mount or affix pipes, cables, hoses in motors, machines etc.

The invention moreover proposes a method to mount, in controlled and monitored manner, a mechanical fastener, where, when mounting or assembling the fastener a previously defined assembling path is covered or overcome and/or assembling is terminated if a pre-defined length or distance has been measured at the fastener. The fastener also measures a force component building up during assembling.

Upon completion of assembling, both the effective path or distance covered and the effective force component built up during assembling are measured and the test values are compared with corresponding setpoint values, allowance being made for given tolerances, so that in case of non-agreement of the actual and setpoint values the procedure shall be displayed as having been unsuccessful.

Preferably both the setpoint values and the actual values are set and detected resp. in a control, measurement and test unit controlling the assembling on one hand and the setpoint-value/actual-value comparison on the other, and finally and preferably memories are provided in the system or coupled to it which store both the actual and the setpoint values for the particular assembly procedure in order to have the capability to check assembling or complement it at a later time.

The invention is elucidated below in relation to the attached drawings.

Figure 3:
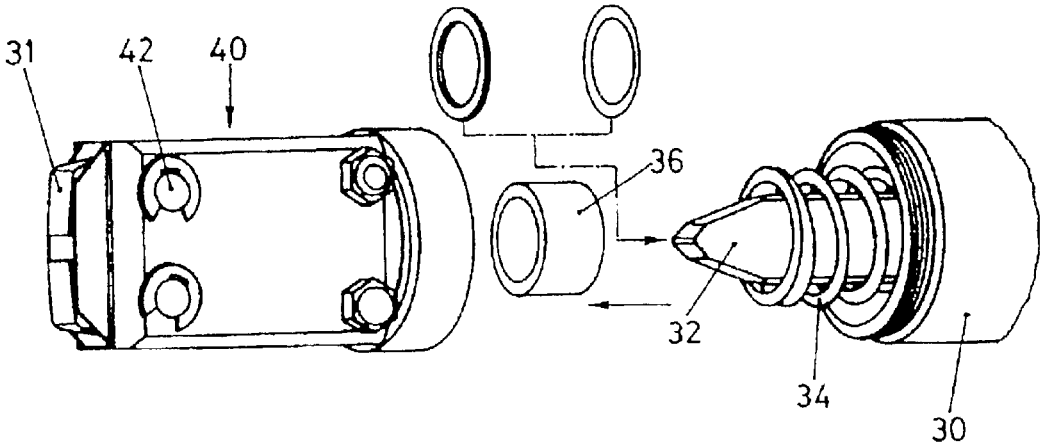
Figure 2:
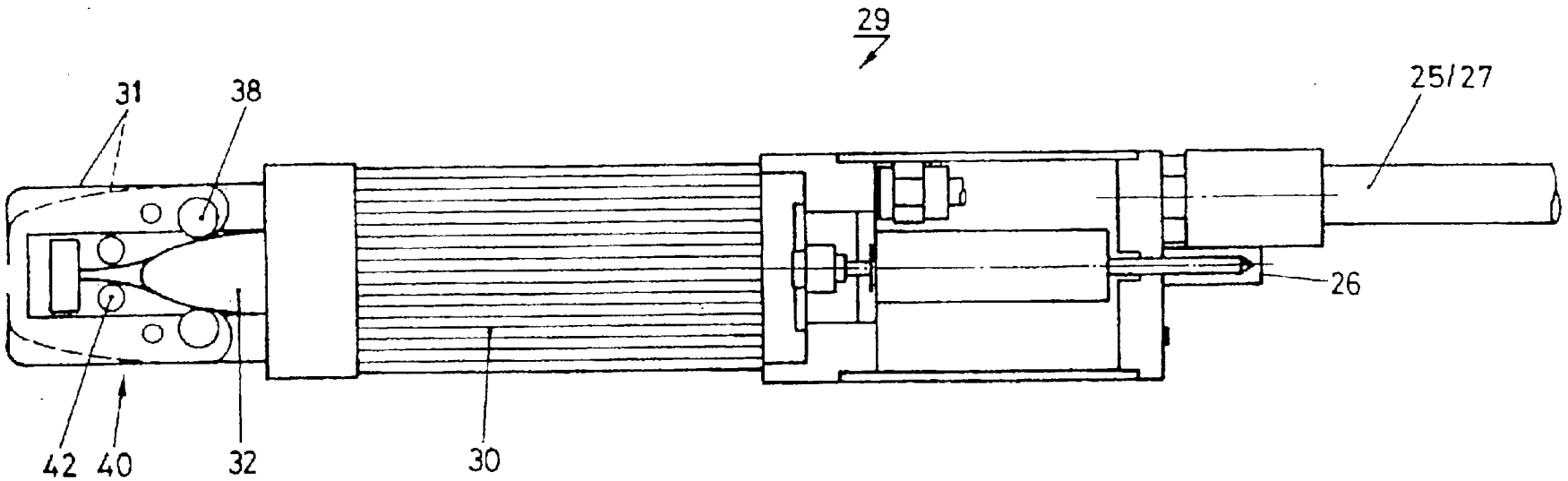
Figure 3A:
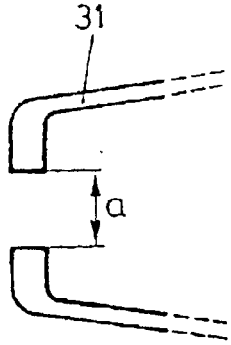
Figure 3B:
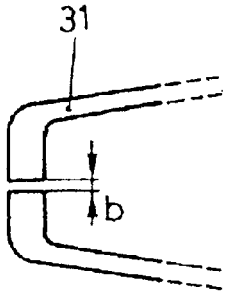
Figure 3C:
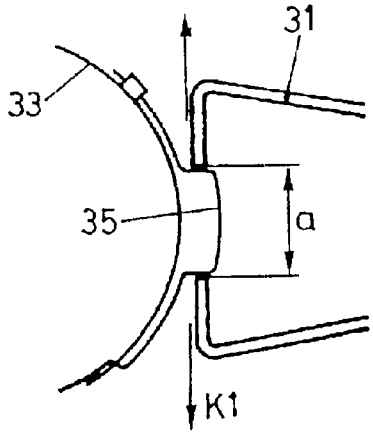
Figure 3D:
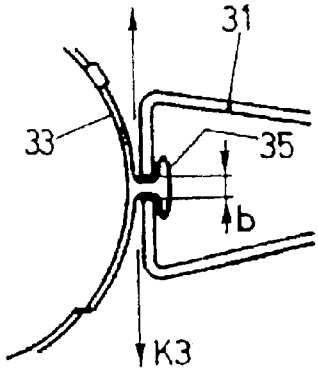
Figure 4:
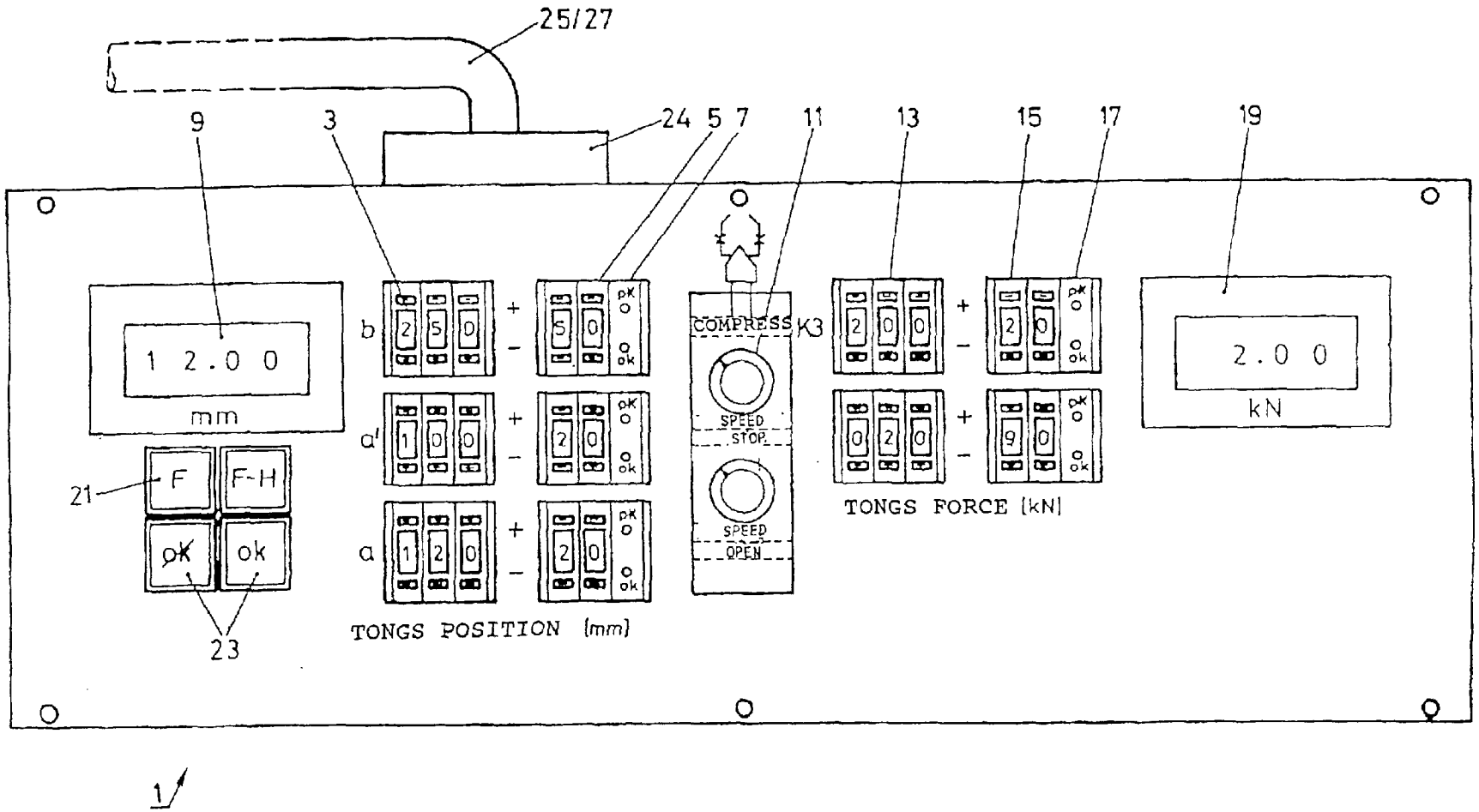
Figure 5:
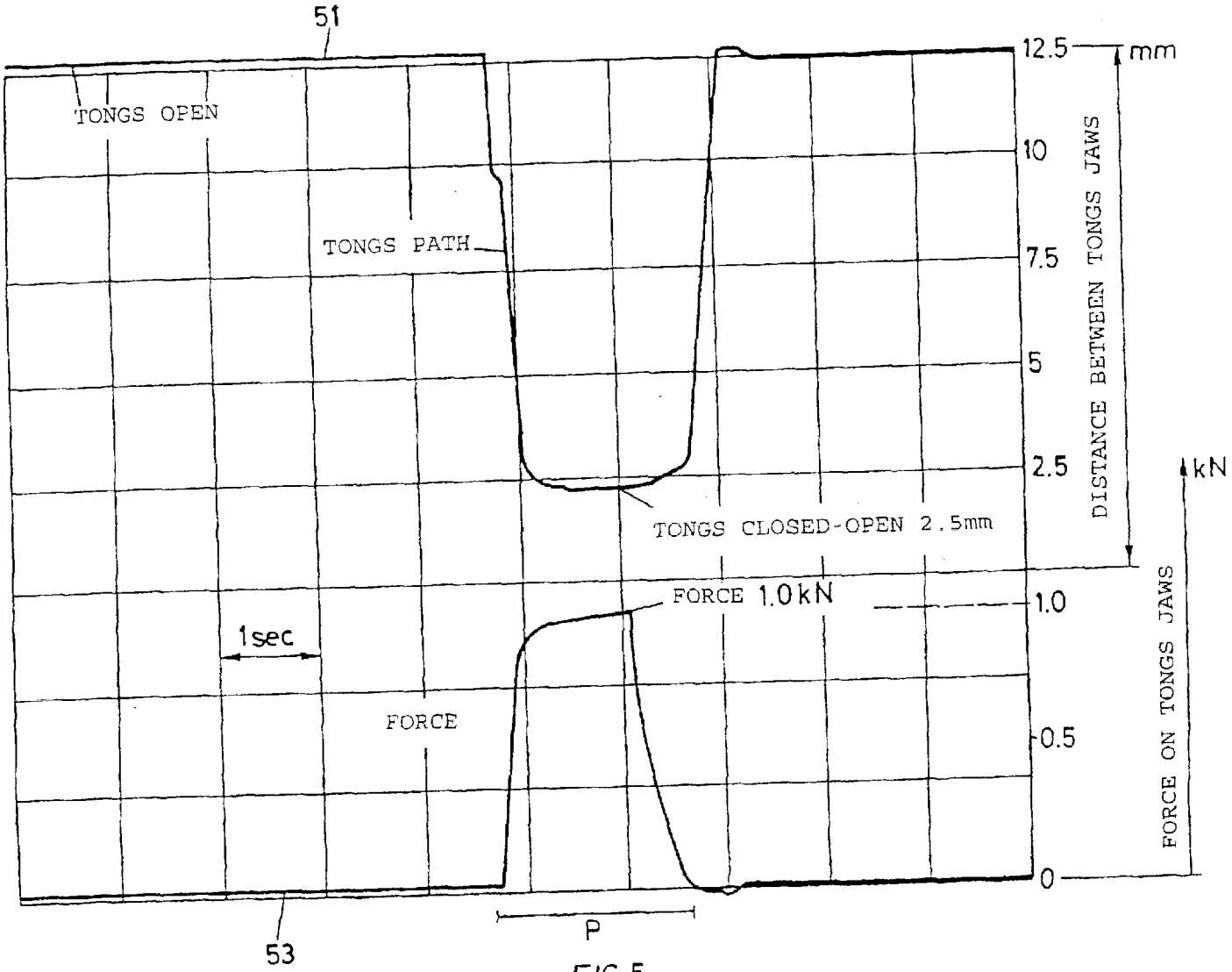
Figure 6:
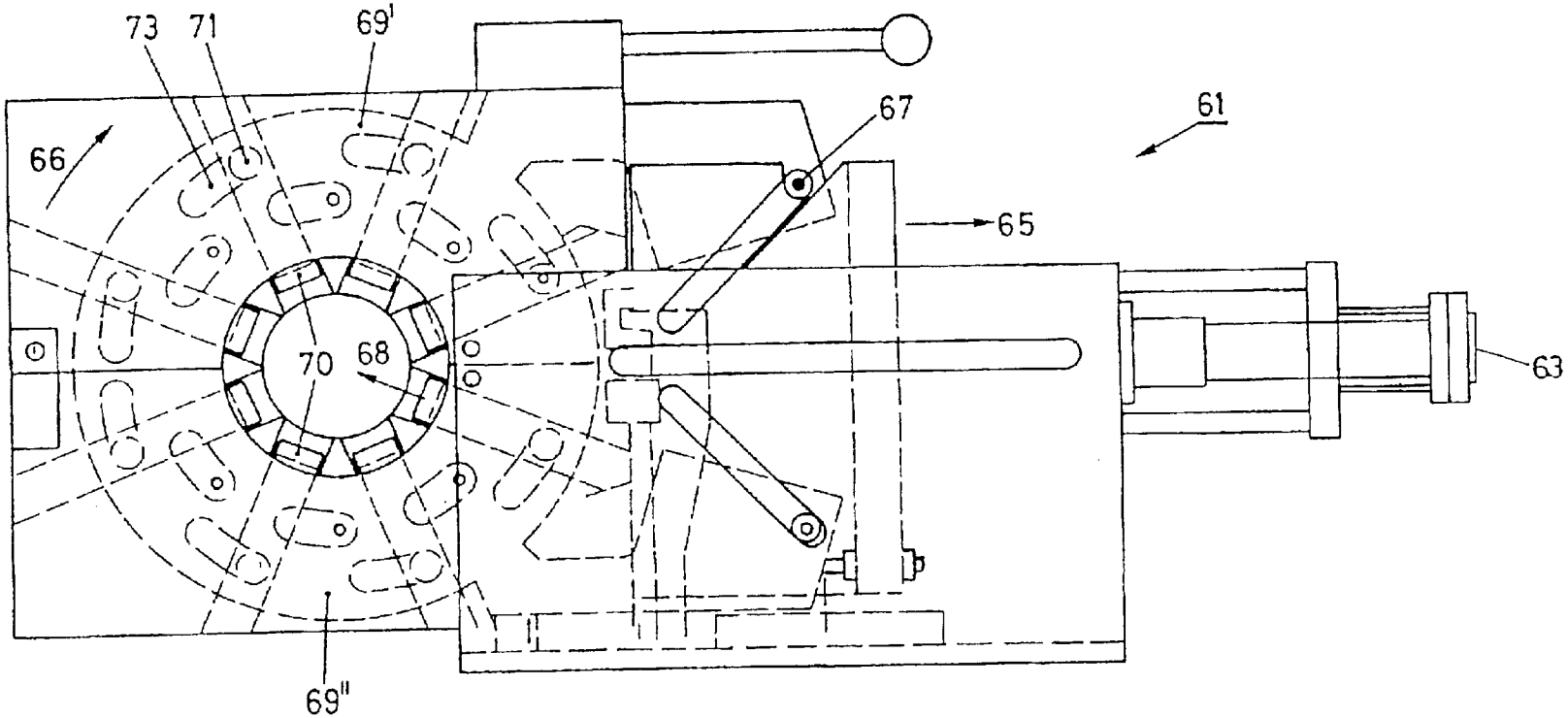
Figure 6A:
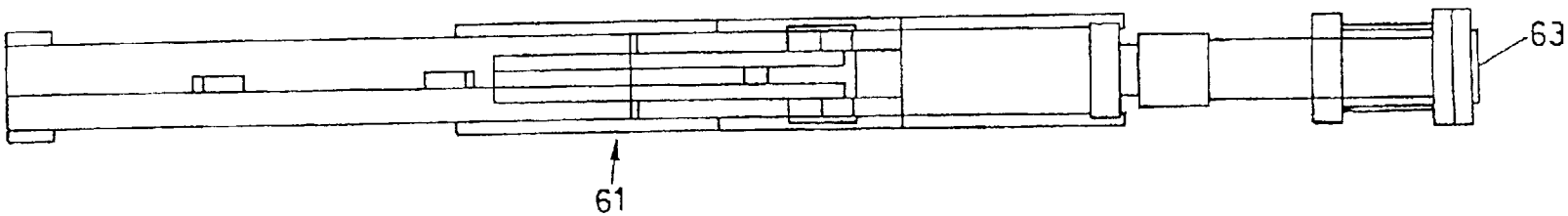
Figure 7:
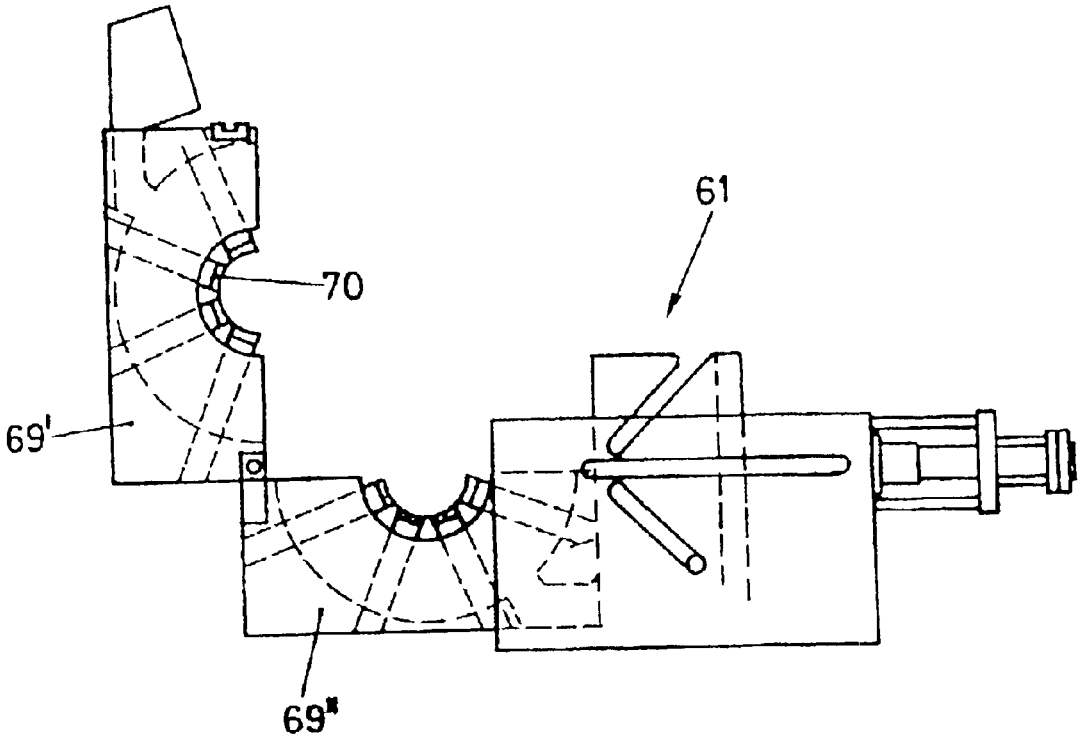

FIG. 1 schematically shows a system allowing controlled and monitored assembly of a pipe clamp, FIG. 2 diagrammatically shows a compression tongs to mount a pipe clamp, FIG. 3 shows the assembling device, ie the tongs jaws of the tongs of FIG. 2, to mount a pipe clamp, FIGS. 3*a–d* diagrammatically show the assembling process, i.e. the basic concept of the invention, FIG. 4 shows a control, measurement and test unit to implement compression in controlled and monitored manner, FIG. 5 is a plot of compression or clamping implemented by the clamping tongs shown in FIGS. 1 through 3, FIGS. 6, 6*a* schematically show a compression tool in longitudinal section used to compress a compression ring, and FIG. 7 shows the compression tool of FIG. 6 in its open state.

FIG. 1 schematically shows a system for mounting a clamping ring in controlled and checked manner, for instance when mounting a plastic or rubber hose to a hookup nipple or when implementing a pipe-hose connection, for instance in a hydraulics or automotive application.

Various assembly parameters which are essential when mounting a clamp or a collar 33 can be set and checked at a control, measurement and test unit 1 in order that the hose/nipple or the hose/pipe connection be implemented in operationally safe manner according to appropriate quality standards. The unit 1 allows adjusting various lengths or distances 3, for instance to determine a path during assembly or to specify a length or distance at the mounted clamp or collar. Moreover the unit 1 allows adjusting tolerances 5 within which the path or the length may vary. A display 9 shows the effectively covered path or the measured length or distance 9, and based on said display 9, another display 7 indicates, for instance visually, whether the setpoint or the predetermined setpoint value 3 now falls within the tolerances 5 during assembly. Illustratively the displays 7 may be red or green pilot lights which turn green in the positive case and red in the negative case. Obviously acoustic signals also may be used to ascertain at once whether the setpoint value was attained.

Various setting knobs 11 are present on said unit 1 to set the operational assembly conditions. Illustratively the rate of assembly, the speed of resetting can be selected by the setting knobs 11.

The unit 1 also comprises an input 13 to set the setpoint value of the clamping force or restoring force to be attained at the clamping ring or at the collars during assembly. Again a tolerance 15 is used, and displays 17 indicate whether the value displayed in display 17 and measured at the clamping ring or the collar agrees with the setpoint value 13.

By means of an electric line 25 and a pneumatic control line 27, the unit 1 drives the clamping tongs 29 comprising at its front side two jaws or legs 31 with which to implement the assembly, i.e. the affixation of the clamp 33 to mount a hose 37 on a pipe or a pipe nipple 39.

FIG. 2 is an enlarged view of the clamping tongs 29, a release knob 26 being provided for instance on the rear side of said tongs to initiate the clamping or compressing procedure. Obviously the initiation or the implementation of the clamping or compression procedure also can be carried out by appropriately controlling the unit 1 in particular when automated or robot work is involved.

In the manner conventionally known in the state of the art to operate clamping tongs, one or more omitted plungers or compression cylinders are present in the front zone 30 of the clamping tongs 29. A clamping wedge 32 is driven in longitudinally displaceable manner by means of said plungers or cylinders and upon a forward displacement will drive apart two rollers 38 which implement the approach and separation of the two tongs legs 31. These clamp jaws 31 are affixed by means of bolts 42 in the assembly head 40.

FIG. 3 is an enlargement of the assembly head 40 in exploded view, the longitudinal wedge 32 being represented projecting from the front segment 30. To assure that, following full advance of this longitudinal wedge 32, this wedge shall be forced back into the front segment 30, the design includes a spacer bush 36 resting against a return spring 34.

By driving the wedge 32 forward, the two rollers 38 and hence the clamp legs 31 are forced to converge, said legs, as already discussed above in relation to FIG. 2, being held by cams or pins 42.

The assembly procedure of the invention is schematically shown in FIGS. 3*a–d*.

FIG. 3*a* shows the two tongs legs 31 in their initial position, that is being spaced apart by a distance "a". These two clamping legs 31 are driven toward each other, as shown in FIG. 3*b*, by actuating the clamping tongs 29. Next the control, measurement and test unit may provide the information that following assembly of a clamping ring or a collar the two clamping legs 31 shall be driven toward each other until a limit distance "b" is reached. However the path covered by the two clamping legs 31, that is the value "a–b" also may be provided.

By compressing for instance a lug zone 35 of a clamping ring or a lug clamp 33 as shown in FIG. 3*c*, a restoring or clamping force is generated per se and acts on the two clamping legs 31. In the initial condition shown in FIG. 3*c*, the force K1 acting through the lug 35 on the two clamping legs 31 is practically zero.

On account of the compression of the two clamping legs 31, the lug 35 will be deformed, i.e. the clamping ring 33 is compressed to such an extent that a hose shall be firmly affixed to a collar. However such a compression of the lug 33 generates a restoring force K3 resulting on one hand from the deformation and even more from the clamping effect of the clamp 33 on the outer hose surface (hose not shown). It is critical in this regard that the two clamping legs 31 be driven toward each other until their separation shall be "b" as predetermined by the control, measurement and test unit. Thereupon the restoring force K3 also is measured and compared with setpoint value 13 entered into the system 1. If there is immediate agreement between the value "b" (or "a–b") and the value K3 on one hand and the pertinent setpoint values 3 and 13 within the tolerances 5 and 15, then the compression or clamping has been carried out successfully. In other words it may then be inferred illustratively that a hose to be mounted on a nipple or pipe was affixed or compressed satisfactorily under given quality standards. Such a conclusion of course also assumes that the pipes or nipples and hoses being used themselves are within required quality standards, that is, that both the material and the sizes of the materials to be joined or compressed do meet certain specifications.

Moreover the actual values measured when compressing or clamping as well as the setpoint value on which the procedure is based can be stored in memory and may be related to a particular and already implemented procedure. In this manner it will be feasible also at a later time to ascertain whether the clamping or compressing procedure was in fact carried out properly. Obviously too it would be advantageous that any defective compressing or clamping steps would be immediately reported, i.e. in visual or acoustic form, whereby such inadequate connections, i.e. clamping or compressing procedures, might be immediately eliminated from the production site.

FIG. 4 shows an enlargement of the control, measurement and test unit 1 of FIG. 1, that is the various control knobs and displays can easily be studied. Illustratively at the nominal window 3, the distance "b" can be set, further the initial position "a" of the tongs legs 31 and additionally a so-called holding position [a'] at which for instance the clamping lug 35 shown FIG. 3*c* already can be held in place. This holding position is especially critical in robot work wherein, by its pivoting motion, a robot arm comprising the pipe clamping tongs first picks up a clamp 33 at its lug 35 and moves it away, and forces it over a pipe or a hose that in turn shall then be forced in automated manner over a nipple or a further pipe, and whereupon the method of the invention to mount the clamping ring or the collar shall be automatically carried out. Thereupon the robot arm is again automatically pivoted away so that another assembly procedure can be carried out.

Corresponding tolerances 5 can be set for each of the three setpoints 3. In addition to setting the tolerances, a display 7 is provided in each case to show whether the input setpoint is being observed. The value measured at the clamping ring or at the clamp is shown at a display 9. The control knobs 11 on one hand allow setting the compression rate, that is the rate at which the wedge 33 is driven forward to drive the two clamp jaws or clamping parts 31. An adjusting system is furthermore provided to allow reopening or retracting the clamping wedge 32.

As already explained in relation to FIG. 1, setpoint values 13 of the force to be attained or to be set may be fed as inputs to the unit 1, both the ultimate clamping force K3 to be attained and the maximally applied compression force during clamping. Again the tolerance may be adjusted and it can be determined from displays 17 whether the actual values correspond to the setpoint values. The actual value is again displayed at a display 19.

Said unit 1 moreover comprises control knobs 21 to set the mode of operation, namely whether for instance the intermediate holding step shall be inserted during assembly or wether the tongs move directly from the distance "a" to the distance "b".

Finally a display 23 will show whether the clamping or compression was successful.

A connector 24 is mounted on the back side of the unit 1 to hook up the pressure and control lines 25 and 27. This connector 24 or its corresponding elements may be polarized in such manner that when the unit 1 stores setpoint values, only a clamping tongs related to such setpoint values can be plugged-in.

FIG. 5 is a plot of the clamping or compression procedure, line 51 showing the tongs' path during assembly and line 53 showing the clamping force generated between the tongs' jaws by the clamping ring or compression ring. The lug 35 is clamped or compressed in the zone P as shown in FIGS. 3*c* and 3*d*. In the process the two tongs jaws 31 move through the path shown in FIG. 5 until for instance the two tongs tips are 2.5 mm from each other. At this time assembly is interrupted and at the same time the force component 53 is measured, also in this zone P. The plot clearly shows that the force buildup is slightly delayed during clamping, that is, when reaching a distance for instance of 2.5 mm, the final clamping force has not yet been reached. Ultimately however a clamping force for instance or 1.0 kN is attained which then is compared with the setpoint value in the unit 1. In case the two values agree within tolerances, the assembly shall be considered having been successful.

FIG. 6 shows another embodiment of an assembly device to mount for instance a compression ring. In this case, for instance in the automotive industry, said device is a circular compression system 61 appropriate to mount a compression ring for instance around a rubber bellows and on an articulating shaft and to affix it. FIG. 6 is a longitudinal section and FIG. 6*a* is a topview of the compression-ring assembly-system 61, a hookup 63 being provided to drive the assembly system, illustratively by means of electrical and hydraulic lines.

By driving the assembly system in controlled manner—for instance hydraulically or pneumatically, a guide plate 65 is displaced in the direction of the arrow, whereby two cams 67 are displaced inside a corresponding slot or recess. By moving the two cams 67, two separate circular halves 69' and 69" of the compression tool are displaced in the direction of the arrow 76 and as a result cams 71 in the slots 73 are moved in the direction of the arrow 68. Thereby the compression jaws 70 again are driven radially inward in the direction of the arrow 68. A compression ring configured in this manner inside the compression jaws 70 is compressed on or against for instance the above cited rubber bellows for the purpose of firmly affixing the bellows to a drive shaft.

In order to allow inserting a completion ring together with the materials to be connected or compressed inside the compression tool, the two semi-circular parts 69' and 69" may be opened as schematically indicated in FIG. 7.

Obviously the systems, clamping tools and compression tools shown in FIGS. 1 through 7 are merely illustrative embodiments used to elucidate the present invention. Basically however the invention applies to any kind of mechanical fasteners or retaining means, the device or system of the invention and the method of the invention being especially appropriate assembling clamps, clamping rings, compression rings, collars, cable ties and the like. Reference is made in this respect in non-limiting manner to clamps such as are illustratively described in the European patent documents 570,742; 591,648 and 503,609 and in the Swiss patents 561,383; 55,026; 669,642 and 677,010. Clamps fitted with lugs as well as lacking them furthermore are known from many patents. For a compression ring, see among others the Swiss patent 679,945 and the European patent document 543,338.

Operation of a clamping tongs is also described in the European patent document 591,648.

The above invention makes feasible mounting, clamping and compressing any fastener and retaining means in monitored and controlled manner, the drive means being pneumatic, hydraulic and also electromechanical as desired. As regards measurement techniques, sensors, electronic control etc., these involve conventional techniques and conventional knowledge which need not be discussed further herein.

In conclusion the operation of lug clamping tongs, as shown in relation to FIGS. 1 through 4, may be selected as follows.

A stationary electro-pneumatic tongs based on the clamping tongs 29 shown in FIG. 1 is fitted with a sensor system such as a driving and analyzing electronics in order to adjustably control the physical values of clamp position, clamp motion and force.

The measured physical values can be compared with the setpoints at the displays of the unit 1 (FIG. 1; FIG. 4) and upon comparison analytical information can be derived.

The illustratively stationary tongs is fitted with a cascaded control composed of a higher, superseding path control and a subordinated force control. The tongs force control is indirect and based on pressure regulation because the $$\text{tongs force} = f(\text{initial force} \times \text{cylinder surface}).$$

By means of a path control circuit and in the initial state (a) as illustratively shown by FIG. 3*a,* the tongs open position can assume an arbitrary position. In an optimal state, the tongs open position will be somewhat larger than the lug 35 of the lug-clamp 33. In this position, two modes of operation to compress the lug may be selected:

(1) Compression to a given position with the default compression force; upon release, and, in relation to its default speed, the tongs jumps from the tongs open position "a" to the compression position (b).

At all times the force control circuit monitors the force function and prevents exceeding the maximum force. Once the maximum force has been reached, compression continues at this force until the setpoint-path has been attained, or, if impossible, the tongs remains in its position. If the default force is not attained, the tongs closes at its compression position.

2.1 Stopping while holding the lug-clamp a' at an adjustable holding force.

2.2 Compressing to a compression position with a default compression force. Upon initiation "a", the tongs, in relation to its speed setpoint, closes from the tongs open position to its holding position [a'].

This holding position is not of a predetermined magnitude, instead it results from reaching a holding force such that it shall hold the lug without deforming it.

Another triggering closes the tongue in relation to its speed setpoint from the holding position to the compression position "b'.

The force control circuit always monitors the force function and prevents exceeding the maximum force. Once the maximum force has been reached, either compression continues at this force until the setpoint path has been reached, or, if this is impossible, the tongs stays in its position. If the setpoint force is not attained, the tongs closes to its compression position "b'.

Optimal compression shall be attained when the lug reaches a compression position corresponding to the data sheet while a defined compression force was applied to it.

Tolerance and timing monitors are used to check those magnitudes and which generate an OK signal 23 when the setpoints are observed, or a NO GO signal 23 when the setpoint is not reached or is exceeded. The physical magnitudes of path and force also are available in alphanumeric form 9, 19 at the interface 19.

What is claimed is:

1. A system to affix or compress a fastener, said system comprising:

a clamping device to mount the fastener, said clamping device comprising a tongs-like element which is driven by a source of power, at least one assembly parameter of the tongs being adjustable, first elements controlling assembly according to a distance, second elements controlling assembly according to a force, at least one setpoint element to control the first elements, and at least one setpoint-value/actual-value comparator to compare at least one component of the force which was built up and measured at the fastener during assembly.

2. System as claimed in claim 1, further comprising at least one drive connected to the clamping device mounting the fastener, the first elements being connected to at least one of the drive and the clamping device such that after commencing assembly a distance is covered at the fastener and/or a distance can be measured at the fastener.

3. System as claimed in claim 1, wherein the second elements are connected to the clamping device and/or to the fastener such that at least one holding force generated in assembly can be measured at the fastener.

4. System as claimed in claim 1, wherein the source of power is at least one of hydraulic, pneumatic and electric.

5. System as claimed in claim 1, comprising a further setpoint element to limit at a maximum value the force component built up in assembly and comprising at least one further setpoint-value/actual-value comparator to compare measured distance values with a setpoint value when a maximum value of the force component is reached.

6. System as claimed in claim 1, further comprising a control, measurement and test unit to control the assembly at the fastener and upon termination of assembly, to detect measured distance values and measured force values, to compare the measured values with the setpoint values and finally to display whether the fastener is mounted in compliance with the setpoint values.

7. System as claimed in claim 6, wherein the control, measurement and test unit comprises display elements being at least one of digital, optical and acoustic display elements to display the measured and detected values and/or to indicate any deviations from the setpoint values.

8. System as claimed in claim 6, wherein the control, measurement and test unit is connected to a storage medium in order that the values measured and detected in recurring assemblies, and any corresponding setpoints, shall be stored.

9. System as claimed in claim 1, wherein the system comprises at least one further measurement element in order to measure or adjust the force exerted by the clamping device against the tongs jaws during or after termination of compression.

10. The system of claim 1, wherein the adjustable assembly parameter comprises at least one of the path covered by the tongs jaws during clamping, the distance between the tongs jaws before and after clamping, the closure gap, the speed of clamping and the clamping force.

11. The system of claim 1, wherein the first elements perform at least one of adjusting, limiting and measuring distances.

12. The system of claim 1, wherein the first elements perform in relation to the path covered by the tongs jaws or distance between the tongs jaws during clamping.

13. The system of claim 1, wherein the second elements perform at least one of adjusting, limiting and measuring forces.

14. The system of claim 1, wherein the second elements perform in relation to at least one clamping force, which is built up when covering or overcoming the path at the fastener or by the fastener, at the clamping element.

15. System of claim 1, wherein the clamping device performs at least one of clamping, affixing and compressing.

16. A method to mount in controlled and monitored manner a mechanical fastener using a system as claimed in claim 1, wherein, the clamping device terminates mounting or assembling the fastener if a predetermined distance is detected at the fastener by the first elements, and wherein a force component, which builds up during assembly, is measured at the fastener by the second elements.

* * * * *